United States Patent [19]

Parsons, Jr. et al.

[11] 4,225,790

[45] Sep. 30, 1980

[54] STORAGE REEL ASSEMBLY

[75] Inventors: George W. Parsons, Jr., North Reading; Riccardo A. Drainoni, Woburn, both of Mass.

[73] Assignee: Technical Operations, Incorporated, Boston, Mass.

[21] Appl. No.: 964,077

[22] Filed: Nov. 27, 1978

[51] Int. Cl.[2] ..... G21F 5/02
[52] U.S. Cl. ..... 250/497
[58] Field of Search ..... 250/497, 496

[56] References Cited

U.S. PATENT DOCUMENTS

| | | | |
|---|---|---|---|
| 2,916,628 | 12/1959 | Prest | 250/497 |
| 3,147,383 | 9/1964 | Prest | 250/497 |

*Primary Examiner*—Harold A. Dixon
*Attorney, Agent, or Firm*—Wolf, Greenfield & Sacks

[57] ABSTRACT

A storage reel for flexible-cable remote manipulating means, which provides a form on which to store a flexible cable and its guide tube on the outside of the form, and which includes permanently fixed inside the form a relatively lighter weight storage tube, of Teflon or the like, for storing a supply of the flexible cable. The storage reel is disclosed in a system for isotope radiography.

10 Claims, 8 Drawing Figures

FIG. 1A PRIOR ART STORED POSITION

FIG. 1B PRIOR ART SOURCE IN TRANSIT

FIG. 1C PRIOR ART SOURCE AT RADIOGRAPHIC SITE

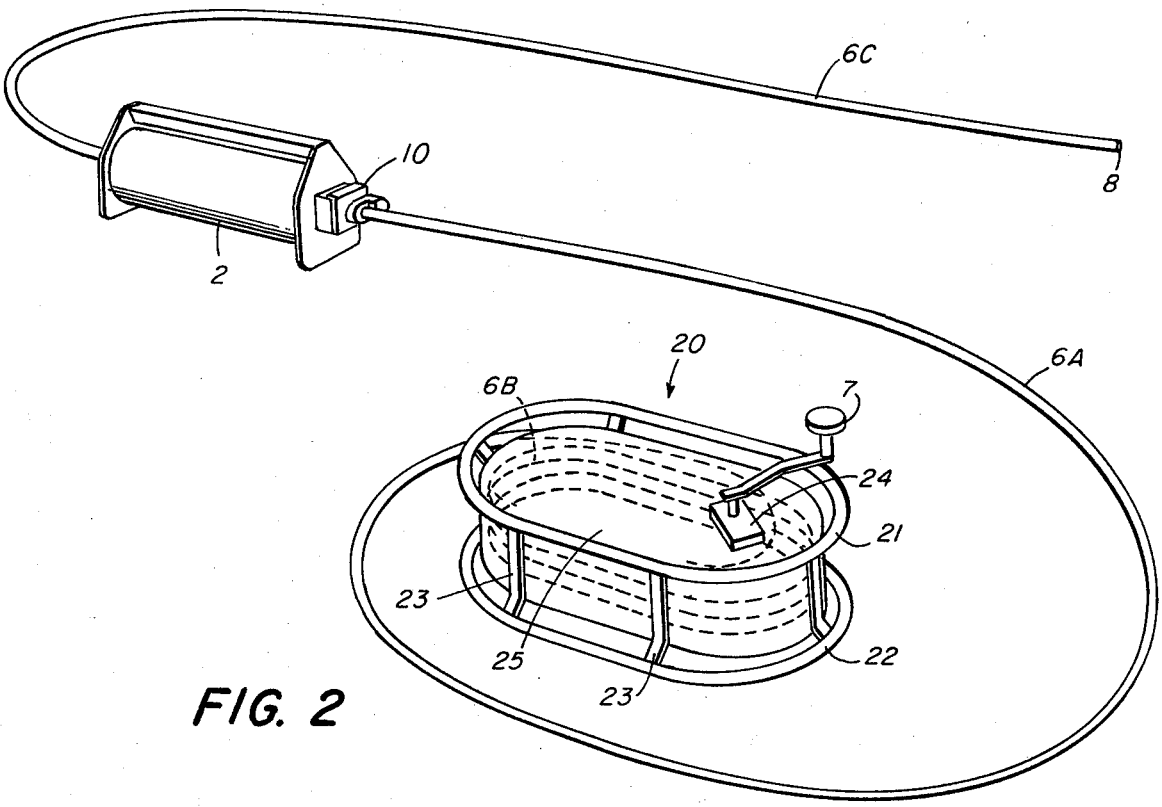
FIG. 2
FIG. 6
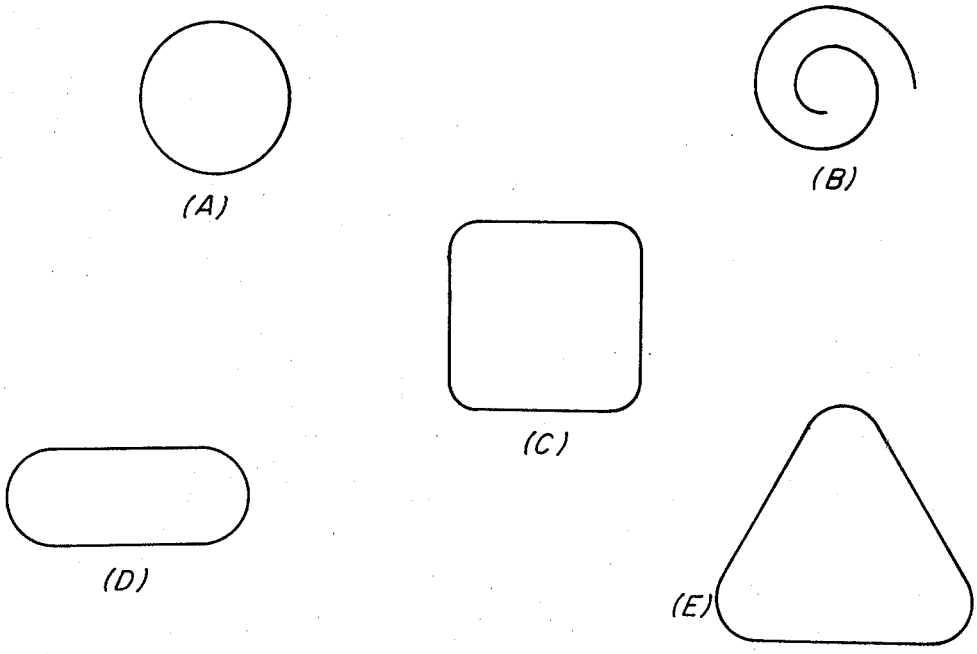

STORAGE REEL ASSEMBLY

THE PRIOR ART

As is shown in FIG. 1 of the accompanying drawings, systems for the handling of radioactive material 1 involve the provision of a storage unit 2 having a mass 3 of radiotion-shielding material with a passage 4 through it, in which the radioactive material can be safely stored when not in use, as is shown in FIG. 1 at A, and from which the radioactive material can be moved to a use location, as for making a radiograph, as is shown in FIG. 1 at C. Typically, the radioactive material 1 is connected to drive means comprising a flexible cable 5 in a guide tube 6. The guide tube is generally provided in three essentially equal-lengths 6A, 6B and 6C, each of which can be disconnectibly coupled to the storage unit 2. Under control of a reel and crank arrangement 7 the drive cable 5 pushes the radioactive material out of the passage 4 and through the third guide tube 6C to a snout 8 located where the radiograph is to be made, as shown in FIG. 1 at B and C. The portion of drive cable 5 in the second guide tube 6B supplies the cable necessary to fill the first and third guide tubes 6A and 6C when a radiograph is being made. A disconnectible coupler 9 is fitted in the drive cable 5 so that when the radioactive material 1 is in the stored position the drive cable can be parted outside the storage unit for uncoupling the cable 5 and the guide tubes 6A and 6B from the storage unit. The part of drive cable 5 between the coupler 9 and the radioactive material 1 is known as the leader 11, and the coupling apparatus 10 between the guide tubes 6A and 6B and the storage unit 2 generally contains means to lock the leader against movement through the passage 4 when the drive means are uncoupled and removed. U.S. Pat. Nos. 3,147,333 and 3,593,594 describe prior systems in which these features are found. As is seen in these patents, two lengths of guide tube 6A and 6B are typically furnished for guiding and protecting the cable 5 and, in use, both lengths of guide tube are laid out between the reel-and-crank arrangement 7 and the storage unit 2.

GENERAL NATURE OF THE INVENTION

The present invention provides improved control apparatus, in which only one guide tube, equivalent to guide tube 6A, is required to be laid out between the reel-and-crank arrangement 7 and the storage unit 2, the extra supply of cable 5 being housed in a second guide tube, equivalent to guide tube 6B, of relatively lighter weight that is permanently coiled at the same location as the reel-and-crank arrangement. This reduces the weight and the cost of systems for handling radiographic material, and simplifies the tasks of setting up and taking down the systems.

BRIEF DESCRIPTION OF THE DRAWINGS

FIG. 2 is a three-dimensional view of a system incorporating a reel-and-crank assembly according to the invention;

FIG. 6 illustrates a variety of coil-shapes that can be used in practicing the invention.

DETAILED DESCRIPTION OF THE DRAWINGS

Figure 1:
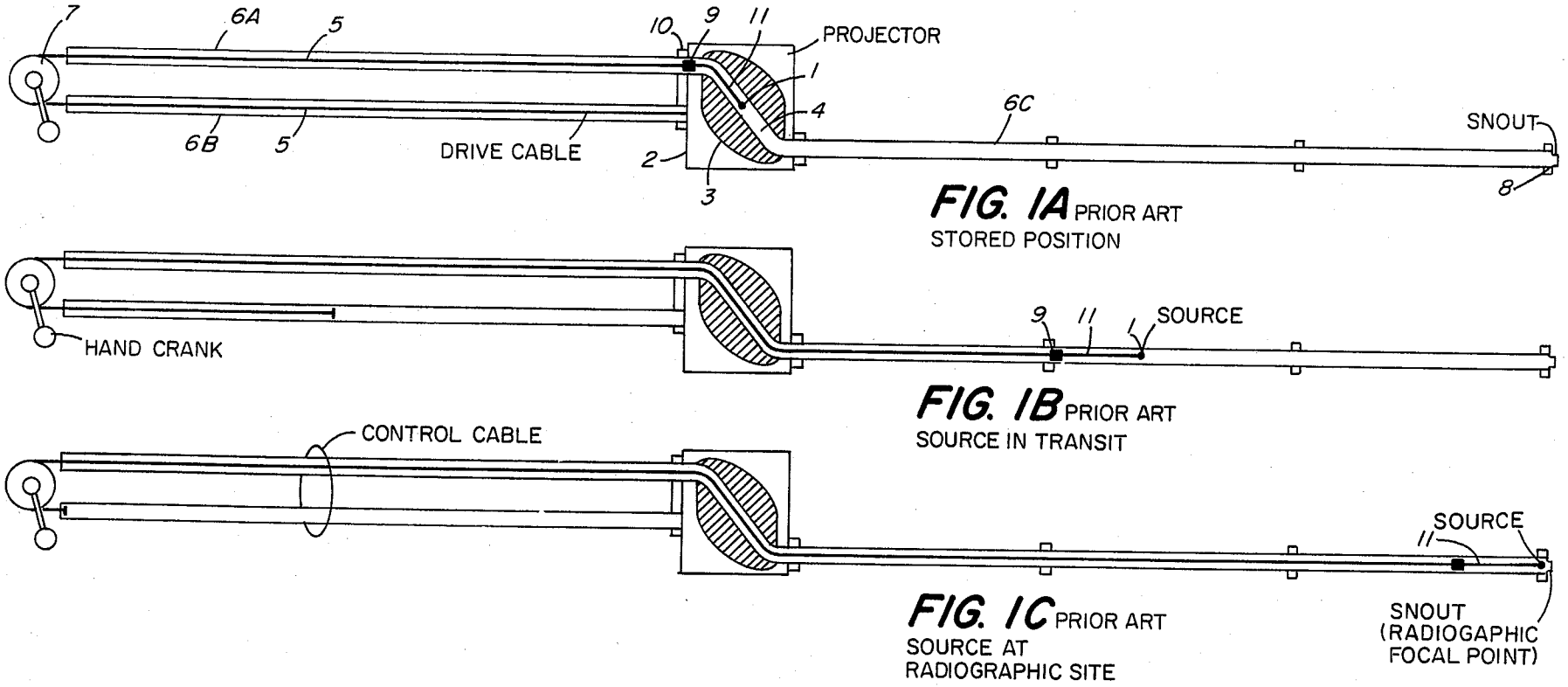
FIG. 1 illustrates a known system, described above, to which the invention is applicable.
Figure 3:
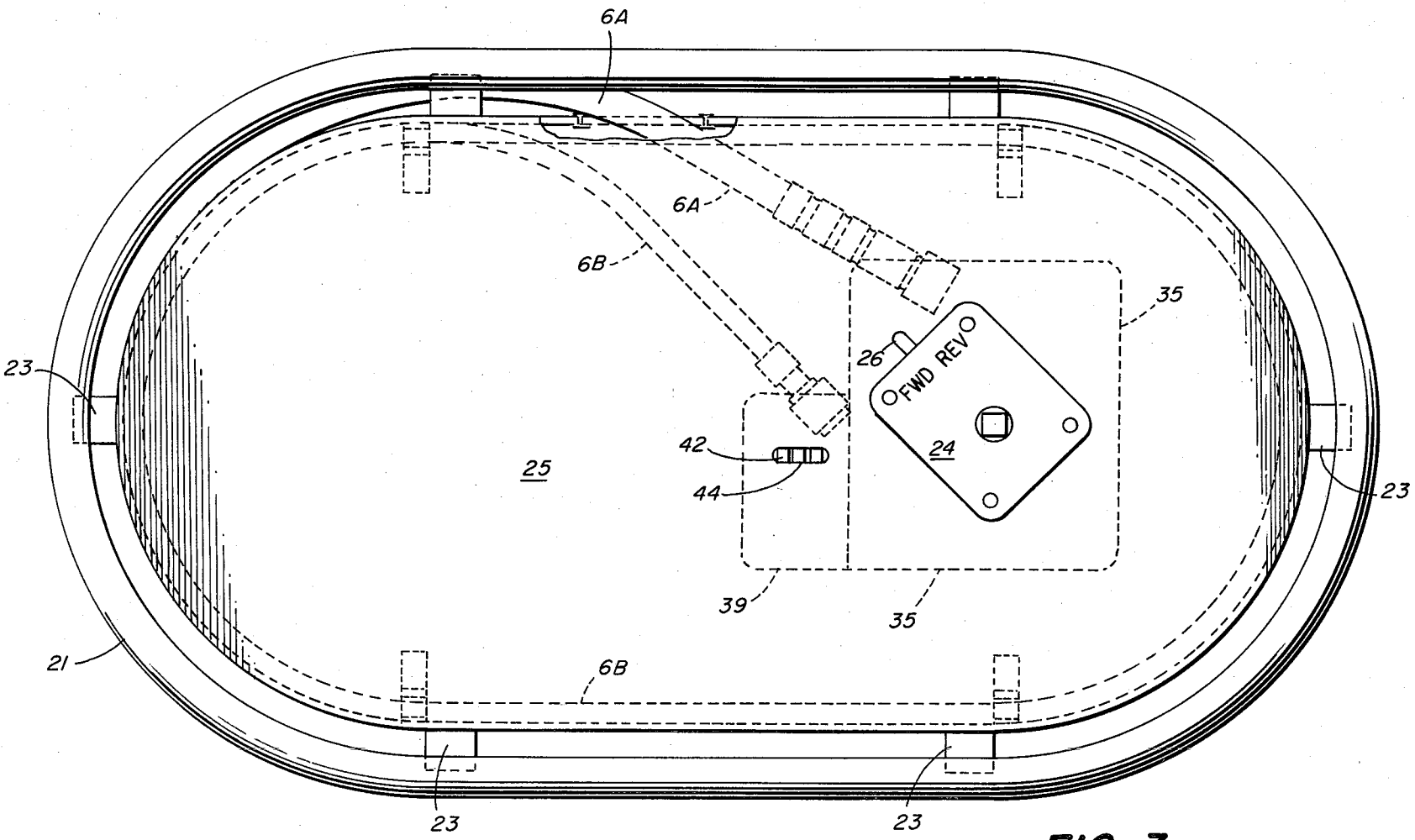
FIG. 3 is a top plan view of the reel-and-crank assembly.
Figure 4:
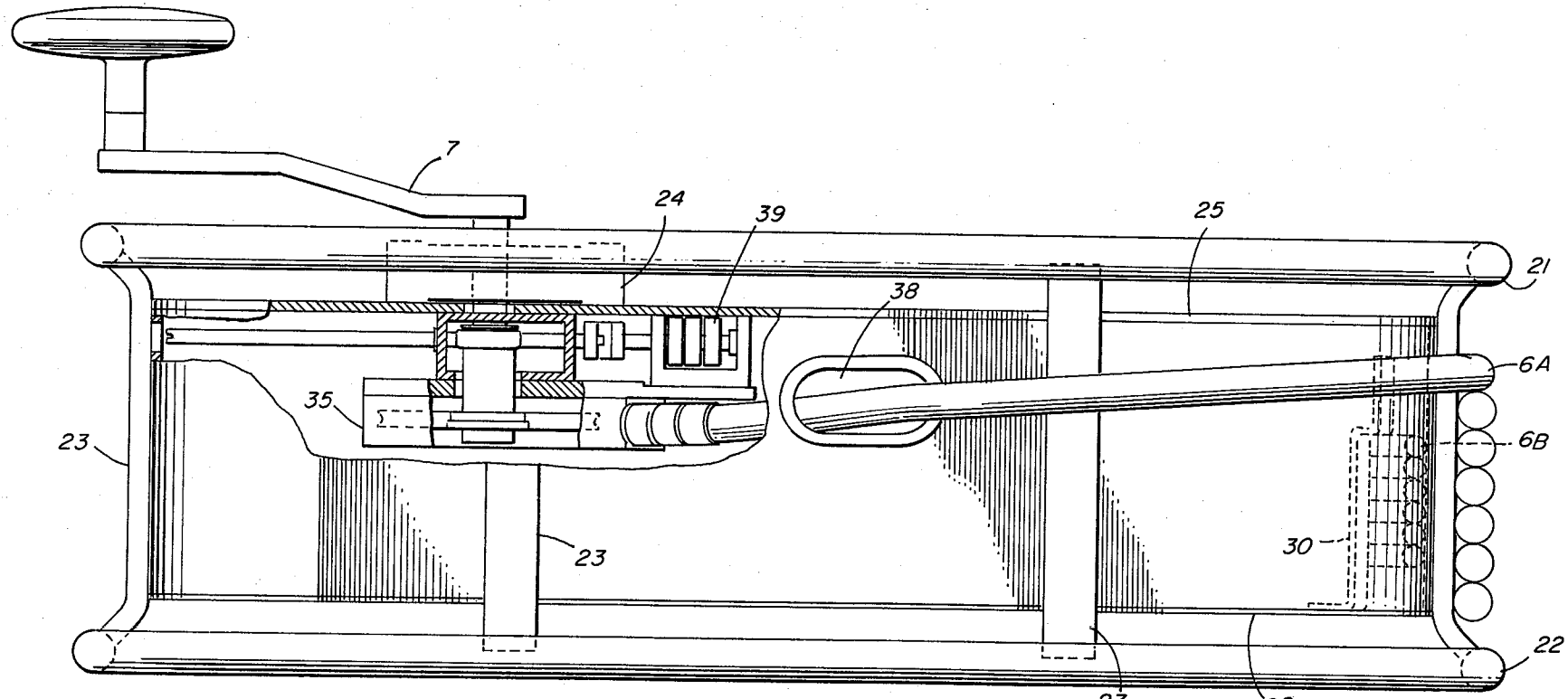
FIG. 4 is a side view of FIG. 3, partly broken away.
Figure 5:
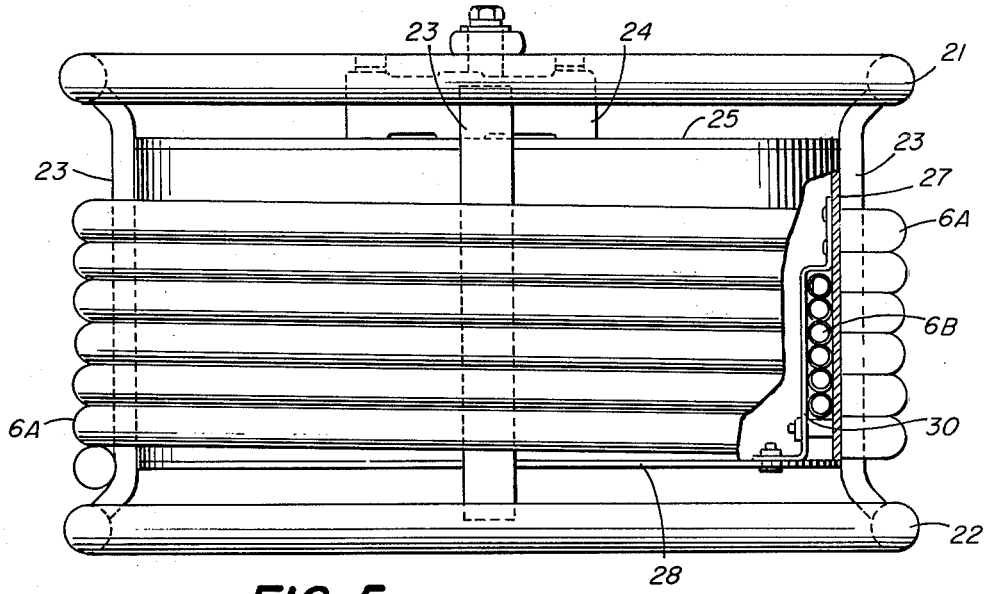
FIG. 5 is an end view of FIG. 3 partly broken away.

In FIGS. 2 to 5, inclusive, a reel 20 of a known configuration has two oval-shaped rails 21, 22 fixed to spanner bars 23 between them on the exterior of which the coupler guide tube 6A can be coiled when the system is not in use. As shown, this guide tube is uncoiled and laid out between the reel 20 and a storage unit 2, to which it is disconnectibly coupled at one end by a coupler 10. The coupler 10 is one that is suitable for coupling a single guide tube and the drive cable 5 (not shown) within it to the storage unit, and a suitable couple is described and claimed in the copending application of the same inventors executed concurrently with this application, Ser. No. 964,078, filed Nov. 27, 1978. The exposure guide tube 6C leading to the snout 8 is also laid out, so that the system, as illustrated in FIG. 2, is prepared for use to make a radiograph. The third or storage guide tube section 6B is permanently coiled under a platform 25, within the spanner bars 23, as illustrated in dashed line. The crank 7 and a direction selector ratchet 24 are shown on the platform 25. The ratchet has a direction change lever 26 which enables the crank to be latched in either of its extreme positions—i.e., radiographic material source 1 fully out into the snout 8, or radiographic material source 1 fully retracted into the storage unit 2. The platform 25 covers a shell-like housing 27 fitted within the spanner bars 23 and closed at the bottom (in FIGS. 4 and 5) with a second cover 28. The storage tube 6B is permanently coiled against the inner wall of the housing 27, and retained in place by several clamps 30 which are each affixed at one end to the bottom cover 28 and the other end to the housing 27. The coupler tube 6A passes from a reel 35 within the housing 27 out through a hole 38 in the housing wall. The storage tube 6B remains at all times inside the housing 27. The reel 35 may be of any suitable kind known to the art; the coupler tube 6A and storage tube 6B are each connected at one end to it, so that a drive cable 5 (not shown in FIGS. 2–5) can be moved from one tube to the other during operation as is shown in FIG. 1. A revolution counter 39, with indicia 42 visible through a window 44 in the top cover 25, but otherwise of known form, is also provided.

The permanently-coiled storage tube 6B can take any convenient configuration. One consideration in choosing a configuration is the torque in inch-pounds that will be required to force the flexible cable 5 around the curves of the permanently-coiled storage tube. FIG. 6 illustrates several possible configurations, at A, B, C, D and E, respectively. Assuming that the storage tube 6B is made of "Teflon" (trademark for a tetrafluoroethylene polymer), inside diameter 0.250 inch., wall thickness 0.030 inch, and that for reference it requires 10 inch-pounds of torque at the crank 7 to force the flexible cable through two (2) straight sections of this tube each 25 feet long (i.e.: one section being equivalent to tube 6B and the other being equivalent to tube 6A) the torque characteristics of each illustrated shape are as follows:

A—Circle
- 16 inch diameter—12 inch-pounds
- 14 inch diameter—15 inch-pounds
- 12 inch diameter—25 inch-pounds B—Spiral—inside diameter of coil = 9 inches, and 7½ turns of coil—25 inch-pounds C—Square—with corners curved on 4½ inch radius—20 inch-pounds D—Oval—two ends semi-cricular on 4½ inch radii, and intervening straight lengths "9"—25 inch-pounds E—Triangle-equilateral—with corners curved on 4½ inch radii and straight sections "9" between corners—25 inch pounds.

The oval configuration shown in FIG. 6 at D is essentially the configuration that is illustrated in FIGS. 2–5, inclusive, that being the configuration which is closest to the shape of reels that have heretofore been used in the art for storing cables and both tubes 6A, 6B on the outside. In the present invention the housing 27 supports and protects the comparatively frail storage tube 30 at its outer periphery, especially at the curved-linear portions where the drive-cable 5 can exert force on it tending to straighten the curve.

We claim:

1. In radiographic apparatus for manipulating a quantity of radioactive material between a stored position and a use position including a capsule of said radioactive material, a storage unit with a passage through it for storing the capsule in the passage and shielding the surrounding environment from the stored radioactive material, manipulating means for location remote from said storage unit, first flexible conduit means connectible to said storage unit between one end of said passage and the manipulating means, and flexible elongated drive means movable within said conduit means and said passage for moving said capsule between a stored position and a use position under control of said manipulating means, the improvement comprising: reel means mounting said manipulating means and providing a form for coiling said conduit means externally around said reel means, and second conduit means permanently coiled on said reel means for housing a supply of said drive means.

2. Apparatus according to claim 1 wherein said second conduit means is coiled within said form.

3. Apparatus according to claim 1 wherein said second conduit means is permanently coiled in a shape including straight-linear and curved-linear portions.

4. Apparatus according to claim 3 including means for supporting said second conduit means at the outer peripheries of said curved linear portions.

5. Apparatus according to claim 1 wherein said second conduit means is a tube made of a flexible material characterized by low sliding friction to drive means housed therein.

6. Apparatus according to claim 1 wherein said first conduit means is a tube reinforced to resist crushing and external abrasion and said second conduit means is a substantially lighter-weight tube devoid of such reinforcing means.

7. Apparatus according to claim 1 including disconnectible coupler means comprised of a first component fixed to said storage unit at said one end of said passage and a second component of tubular shape fixed at one end to an end of said flexible conduit means remote from said manipulating means, said first component having a tubular aperture for receiving said second component endwise therein, and means for releasably locking said second component to said first component.

8. Apparatus according to claim 1 including a support affixed to said form and mounting said manipulating means, said form including wall means providing a housing, said second conduit means being fixed to said wall means within said housing.

9. Apparatus according to claim 8 including closure means for said housing, said manipulating means including a portion within said housing communicating with both of said conduit means, and a hand crank portion outside of said housing.

10. Apparatus according to claim 9 wherein said first-named conduit means extends through said wall means for communicating with said manipulating means inside said housing.

* * * * *